United States Patent [19]

Beruto et al.

[11] Patent Number: 4,737,441

[45] Date of Patent: Apr. 12, 1988

[54] PHOTOGRAPHIC MATERIAL FOR TANNING DEVELOPMENT AND METHOD FOR OBTAINING A RELIEF IMAGE

[75] Inventors: Marco Beruto; Antonio Luzzi; Piero Ramello, all of Savona, Italy

[73] Assignee: Minnesota Mining and Manufacturing Company, St. Paul, Minn.

[21] Appl. No.: 867,326

[22] Filed: May 23, 1986

[30] Foreign Application Priority Data

May 30, 1985 [IT] Italy ..... 20978 A/85

[51] Int. Cl.[4] ..... G03C 1/06; G03C 5/24

[52] U.S. Cl. ..... 430/264; 430/566

[58] Field of Search ..... 430/264, 566

[56] References Cited

U.S. PATENT DOCUMENTS

| | | | |
|---|---|---|---|
| 3,143,414 | 8/1964 | Yackel et al. | 96/27 |
| 3,300,307 | 1/1967 | Smith, Jr. | 96/36 |
| 3,364,024 | 1/1968 | Yackel et al. | 96/29 |
| 4,269,929 | 5/1981 | Nothnagle | 430/264 |
| 4,283,479 | 8/1981 | Hamaoka et al. | 430/264 |
| 4,299,909 | 11/1981 | Imatomi et al. | 430/264 |
| 4,369,245 | 1/1983 | Beruto et al. | 430/264 |
| 4,504,572 | 3/1985 | Beruto et al. | 430/264 |

FOREIGN PATENT DOCUMENTS

| | | |
|---|---|---|
| 0105109 | 4/1984 | European Pat. Off. . |
| 1463899 | 11/1966 | France . |
| 8504025 | 9/1985 | PCT Int'l Appl. . |

*Primary Examiner*—Paul R. Michl
*Assistant Examiner*—Mark R. Buscher
*Attorney, Agent, or Firm*—Donald M. Sell; James A. Smith; Mark A. Litman

[57] ABSTRACT

A photographic material for tanning development which comprises a photographic support base, at least one tannable binder material, at least one silver halide emulsion and at least one pigment, said material including a 3-pyrazolidone compound and at least two different 1,4-dihydroxybenzene compounds, the first of which is chosen within the group of those having a standard tanning development time (STDT) of one fourth to twice the hydroquinone STDT (STDTHy) and the second of which is chosen within the group of those having a STDT of one fourth to fifteen times the STDTHy.

Most preferably, the above photographic material includes hydroquinone in addition to the 3-pyrazolidone compound and the two 1,4-dihydroxybenzene compounds, wherein the first 1,4-dihydroxybenzene compound, other than hydroquinone, is chosen within the group of those having a STDT of one fourth to twice the STDTHy and the second 1,4-dihydroxybenzene compound is chosen within the group of those having a STDT of two to fifteen times the STDTHy.

A method to obtain relief images by using the above said photographic material.

20 Claims, No Drawings

PHOTOGRAPHIC MATERIAL FOR TANNING DEVELOPMENT AND METHOD FOR OBTAINING A RELIEF IMAGE

FIELD OF THE INVENTION

The present invention refers to an improved photographic material for tanning development and to a method to obtain relief images upon tanning development.

The tanning development technique is based on the capability of some compounds (tanning developers) to be oxidized in the presence of exposed silver halide and an alkaline environment, to give compounds which react (during the development process) with a tannable material which is made water-insoluble. In an exposed silver halide photographic film including a tanning developer, relief images are obtained by first developing the film and then using an aqueous solution to wash off the tannable material not made water-insoluble.

This technique is used to obtain relief images characterized by a very sharp contrast, low silver content, and good light-sensitivity. These materials are used mainly in the fields of the reproduction and photocomposition of technical drawings or other line images, where the possibility of easily canceling or correcting images is required.

One of the main difficulties encountered by the tanning development technique in the Graphic Arts field derives from the tanning rate. Moreover, the material must be provided with all other characteristics necessary to impart a good reliability and quality, such as for instance stability (maintenance of the photographic properties of the films, particularly under damp heat conditions), resolving power, reproduction of the grey tones, quality of the image edges, sensitometry and development homogeneity.

BACKGROUND OF THE ART

In addition to hydroquinone, many other compounds have been described as tanning developers. In particular, bromohydroquinone, chlorohydroquinone, methylhydroquinone and morpholino-methylhydroquinone are described as tanning developers in U.S. Pat. No. 3,364,024. Gentisic acid and its combination with a 3-pyrazolidone auxiliary developing agent are described in U.S. Pat. No. 3,300,307. Methyl gentisate, gentisamide, gentisaldehyde, β-hydroxyethylgentisamide, gentysaldoxyme, phenoxyhydroquinone, toluenehydroquinone, durohydroquinone, xilohydroquinones and pseudocumohydroquinones are described as tanning developers in U.S. Pat. No. 3,143,414.

One of the main requirements of the tanning development material is that of allowing film processing with automatic processing machines which often have a high turbulence in the activation region. In this region, where the film development is activated by alkaline solutions substantially free of developers, the developers contained in the films and/or the quinones formed thereby upon development of the silver halides, can be lost in the external water solution before sufficient tanning development and formation of an irreversible and mechanically resistant gel can take place.

To overcome the problem (which is connected with the tanning rate referred to before), the use of poorly soluble and/or poorly migrating developers has been proposed (U.S. Pat. Nos. 4,283,479; 4,299,909; 3,440,049; 3,453,109; 2,751,295 and GB Pat. No. 2,044,943). Examples of such compounds are alkyl gallates, alkylcatechols and phenyl- or phenoxy-hydroquinones.

French Pat. No. 1,463,899 describes several tanning developers wherein at least a hydrogen atom of the benzene nucleus of the hydroquinone is substituted with high molecular weight alkyl groups. Examples of such developers are diisooctylhydroquinone and 2,5-dihydroxy-4-octadecyl-benzenesulfonic acid.

Even in this case, the developer usefulness is due to its poor capability of migrating which prevents its sublimation or migration while storing or processing the virgin films including it.

Some of these developers give satisfying results in materials for the reproduction and photocomposition of technical drawings or other line images, but not for realizing competitive and reliable materials in the most sophisticated sector of the Graphic Arts such as that of dot formation, where high quality images are required.

For example, in the materials containing spirobiscromanes combined or not with other co-developers deriving from catechol or gallic acid, there is still a certain difficulty in removing the non-tanned regions of the layer contained between two tanned lines particularly close to each other, which is necessary when very high resolving power, a good tone reproduction, and image edge quality are required.

R. B. Pontius (PSA Journal, Section B, September 1951, page 76, volume 17 (Phot. Sci. Tech.), divides the developers into tanning, poorly tanning and non tanning developers and mentions some cases of tanning synergism and even cases of anti-tanning synergism. Although this article points out in particular the tanning synergism, no example of synergism related to the use of at least two different hydroquinone structures is mentioned.

DETAILED DESCRIPTION OF THE INVENTION

It has been found that an improved photographic material for tanning development comprising a support base, at least one tannable binder material, at least one silver halide emulsion and at least one pigment, is obtained when it includes a 3-pyrazolidone compound (auxiliary developer like phenidone) and at least two different 1,4-dihydroxybenzene compounds, the first of which is chosen within the group of those having a standard tanning development time (STDT) of from one fourth to twice the hydroquinone STDT (STDTHy) and the second of which is chosen within the group of those having a STDT of one fourth to fifteen times the STDTHy, said STDT values being measured under gelatin/1,4-dihydroxybenzene compound ratios like the gelatin/hydroquinone ratio. Preferably the photographic material described above comprises a first 1,4-dihydroxybenzene compound chosen within the group of those having a STDT from one fourth to twice the STDTHy and a second 1,4-dihydroxybenzene compound chosen within the group of those having a STDT of two times to fifteen times the STDTHy.

In one aspect, said two different compounds are both preferably chosen in the group of those having a STDT of one fourth to twice the STDTHy, at least one of them being a hydroquinone compound substituted with a leaving group substituent.

By the expression leaving group substituent is meant herein a substituent of the hydroquinone benzene nucleus which is capable of giving substitution reactions with the gelatin (particularly with amine groups thereof) when the hydroquinone compound is oxidized to its oxidized quinone form. Examples of these substituents are halogen substituents (such as chlorine and/or bromine), sulfonic acid ($SO_3H$) and alkyl (preferably low alkyl groups having 1 to 4 carbon atoms) or aryl (preferably phenyl or substituted phenyl groups wherein the substituents are halogen, such as chlorine, bromine or fluorine or alkyl or alkoxy groups having 1 to 4 carbon atoms) sulfo groups, preferably halogen substituents.

In another preferred aspect, one of said two different compounds is chosen in the group of those having a STDT of one fourth to twice the STDTHy and the other is chosen within the group of those having a STDT of two ro fifteen times the STDTHy.

Most preferably, the photographic material described above comprises hydroquinone in addition to phenidone and two 1,4-dihydroxybenzene compounds, wherein the first 1,4-dihydroxybenzene compound, other than hydroquinone, is chosen within the group of those having a STDT of from one fourth to twice the STDTHy and the second 1,4-dihydroxybenzene compound is chosen within the group of those having a STDT of from two to fifteen times the STDTHy. In fact, the use of the two 1,4-dihydroxybenzene compounds in the presence of phenidone has been found to give a STDT lower than the STDT of an element including a hydroquinone compound of said first group, in most cases lower than half such STDT. Results are in fact obtained with the tanning development combination of the present invention which in terms of tanning time and effectivenes are significantly better than those obtained with the known tanning development systems. Furthermore, the tanning system according to the present invention is compatible with the preparation of a photographic material for Graphic Arts and provided with all those characteristics required from this type of material, such as for instance stability to damp heat, and formation and reproduction of dot and lines. In fact, an improvement in image quality has been obtained by lowering the tanning development time according to the present invention.

The expression "standard tanning development time" or "STDT", as used herein, means the minimum time necessary to develop, in an alkaline environment, the latent image formed upon exposure to light of the silver halides and cause the developer oxidation products, formed in the presence of developable $Ag^+$, to make insoluble the tannable material present in the latent image regions. The value of fifteen times the STDTHy is considered herein a time limit value and includes the case in which no image or no acceptable image is obtained in spite of the long tested development time. The structure and composition of the photographic material, the light exposure and the method to evaluate the STDT are defined hereinafter.

"Standard" Structure and Composition of the Photographic Material

The structure and composition of the photographic material used to evaluate the STDT comprises a conventional polyester support base having coated in the order:

(1) a layer containing 0.75 g/m$^2$ of black colloidal silver dispersed in 2.2 g/m$^2$ of non-hardened gelatin and 0.0175 g/m$^2$ of phenidone and the 1,4-dihydroxybenzene compounds of the present invention;

(2) a light-sensitive non-hardened gelatin layer comprising 0.5 g/m$^2$ of gelatin coated at pH 5, 0.35 g/m$^2$ of silver ions of a conventional lithographic silver halide emulsion containing 64% mole chloride and 36% mole bromide, sensitized to the green light, and 0.08 g/m$^2$ of 2,5-diisooctylhydroquinone dispersed in a dibutylphthalate and tricresylphosphate mixture;

(3) a protective layer containing 0.5 g/m$^2$ of non-hardened gelatin and 0.15 g/m$^2$ of 2,5-diisooctylhydroquinone dispersed as said hereinabove.

To evaluate the STDT to the purposes of the present invention, the various tanning compounds are each tested at their optimum quantity to obtain a good image with no problems of gelatin coatability in this standard material. As already indicated, it is generally believed that quantities higher than 1 gram per square meter would not be practical to the purposes of the invention.

"Standard" Light Exposure

To evaluate the STDT, the photographic materials are exposed upon contact through the emulsion in a PRT TYPE RB DIGIT 3 bromograph, having a 50 W, 12 V Osram Tungsten Halogen lamp, set in the 1-position, with an UGRA-GRETAG TM PLATE CONTROL WEDGE for 5 seconds (really these conditions are not crytical; exposure time can be varied, for example, up to 8 seconds).

"Standard" Process

The process to evaluate the STDT comprises processing the exposed photographic material with the following steps:

| | | |
|---|---|---|
| (1) Development (by activat.) | $Na_2CO_3$ | 1% |
| | $Na_2SO_4$ | 12% |
| | $NaHCO_3$ up to a pH of 10 | |
| | T = | 32° C. |
| (2) Wash off | Water at 38–40° C., turbulence | |
| (3) Spray washing | Water at 15–30° C. with a 1 atm pressure | |
| (4) Hot air drying. | | |

"Standard" Evaluation Method

More samples of each "Standard" photographic material, including the developer(s) under evaluation, are exposed and processed in a "standard" way as per above at increasing times starting from 10 seconds of stay in the activation section. For each material the minimum tanning development time (STDT) was recorded corresponding to the best reproduction of both transparent lines on black background and black lines on transparent background.

The 1,4-dihydroxybenzene compounds of the present invention include hydroquinones and those compounds wherein one or more hydrogen atoms of the benzene nucleus are substituted with halogen atoms or with electron-withdrawing groups (the term electron-withdrawing group relates to the capability of certain groups of withdrawing electrons from the carbon atoms or the organic substrate to which they are attached, as described for example in Organic Chemistry, S. H. Pine et al., Fourth Edition, McGraw Hill Book Co., pages 207ff).

Examples of suitable electron-withdrawing groups preferred as substitutents of the 1,4-dihydroxybenzene according to the present invention are the carboxyl group and its functional derivatives, such as esters and amides, the ketocarbonyl group, the sulfonyl group, the sulfonic group, the sulfonilamido group, the quaternary ammonium and sulfonium groups, the nitrile group and the trifluoromethyl group.

Examples of typical 1,4-dihydroxybenzene compounds having a STDT which is 2 to 15 times the STDTHy, according to the present invention, are gentisic acid and the alkyl (preferably low alkyl groups having more preferably 1 to 4 carbon atoms) and aryl (preferably phenyl or substituted phenyl groups wherein the substituents are halogen such as chlorine, bromine or fluorine or alkyl or alkoxy groups having 1 to 4 carbon atoms) esters thereof, 2,5-dihydroxybenzenketones, 2,5-dihydroxybenzenesulfonic acids and the salts or functional derivatives thereof, such as sulfones and poly-halogenhydroquinones. Specific examples of preferred compounds are gentisic acid, methylgentisate, 2,5-dihydroxyacetophenone, sodium 2,5-dihydroxybenzensulfonate, sodium 1,4-dihydroxybenzene-2,5-disulfonate, 2,5-dihydroxybenzenephenylsulfone and tetrachlorohydroquinone.

Examples of typical 1,4-dihydroxybenzene compounds having a STDT which is one fourth to twice the STDTHy are gentisamide, N-alkylgentisamides wherein the alkyl group has preferably a low molecular weight (more preferably having 1 to 4 carbon atoms) and can be substituted with a hydroxy group, 2,5,2',5'-tetrahydroxydiphenylsulfone and mono-hydroquinones. Specific examples of preferred compounds are hydroquinone, gentisamide, β-hydroxyethylgentisamide, monochlorohydroquinone, 2,5,2',5'-tetrahydroxydiphenylsulfone and mono-bromohydroquinone.

The combination of the tanning developers according to the present invention can be used with different types of emulsion and layer arrangement.

Any support base known in the art is suitable. In some cases, bases without any subbing layer or with unhardened subbing layers are preferred. In other cases, special bases are preferred which can be coated on both sides or have subbing layers which allow image-transfer onto a new and different base. Each coated side of the base can have also more than one layer.

All layers must be removable, for instance with hot water, from the undeveloped regions and must differentially resist the above mentioned processings in the developed regions, where the layers must get insoluble and hardened. This is achieved for instance by using gelatin as tannable material and omitting the harneders. Also those natural or synthetic polymers or other auxiliaries known in the art can be used at least in part as substituents of the gelatin.

At least one layer will contain at least a silver halide emulsion.

All emulsions known in the art are suitable, such as the negative or the direct positive, high or low sensitivity emulsions having silver chloride and/or bromide and/or iodide.

Under the same sensitivity, the most preferred emulsions are however the finest grain and most quickly developable emulsions or those having the largest specific surface, whatever may be the grain shape.

At least one layer will contain at least one pigment or a precursor capable of absorbing at least one part of the photons having a wavelength comprised between 350 and 800 nm.

Another useful characteristic of the pigments used according to the present invention is that they must have the highest specific absorption and yet cause the least possible interaction with the gelatin or the other components of the layer.

Examples of preferred pigments are those which do not tend, with the time and/or oxygen and humidity, to make insoluble gelatin and/or to compromise the capability of the tannable material to be hardened in the developed regions and to be on the contrary removed from the undeveloped regions. For instance, the most untreated carbon-black compounds are preferred not to be used, since with the time they prevent the layers from being washed-off from the undeveloped regions.

Those dispersions of black colloidal silver or those different from black colloidal silver, which allow the highest optical density of the layers with the lowest silver and gelatin coverage, are therefore preferred.

Organic pigment dispersions are also useful to the purposes of the present invention. They are preferred when layers having a color different from back are desired. To this purpose, the dispersions of pigments which absorb outside the visible region are also useful, such as the ultraviolet or infrared absorbers to be combined or not with the colored or black pigments which absorb in the visible region.

The developers can be present in one or more light-sensitive layers or in the subbing layers, interlayers or protective layers, if any.

The developers can be partially or totally present also in the processing solutions, but they are preferred to be put mainly or exclusively into the material.

The photographic material for tanning development of the present invention is associated with one or more 3-pyrazolidone compounds, such as for instance phenidone, known in the art as silver halide auxiliary developing agents (see for example GB Pat. Nos. 542,502; 761,300; 1,093,281; IT Pat. No. 498,462; U.S. Pat. Nos. 2,772,282; 3,300,307 and EP application No. 104,351). Examples of such developing agents are 1-phenyl-4,4-dimethyl-, 1-phenyl-5-methyl-, 1-chlorophenyl-, 1-phenyl-5,5-dimethyl-, 1,5-diphenyl-, 1-phenyl-4-ethyl-, 1-phenyl-4,4-dihydroxymethyl-, 1-p-tolyl-4,4-dihydroxymethyl- and 1-phenyl-4-hydroxy-methyl-4-methyl-3-pyrazolidone compounds.

The 3-pyrazolidone compounds are preferably placed into the photographic material according to the present invention in quantities not exceeding 0.2 $g/m^2$, more preferably not higher than 0.05 $g/m^2$ and most preferably than 0.03 $g/m^2$.

The present invention has been developed in particular with reference to a photographic material for tanning development the structure of which is the one described hereinbefore to evaluate the STDT values. It is understood however that the present invention is not limited to this particular structure.

Examples of different structures possibly useful to the purposes of the present invention are given by the following schemes:

(I) B/D/C
(II) B/C/D
(III) B/D+C
(IV) B/D/C/D
(V) B/C/D/C where, for simplicity, the possible subbing layers, interlayers or protective layers have been omitted and wherein:

B is a transparent or opaque photographic support base, such as for instance polyesters, glass, paper or metal;

C is a layer containing a finely dispersed pigment or a precursor thereof;

D is a layer containing one or more photographic emulsions;

D+C is a layer at the same time containing emulsions and pigments.

Further to the above mentioned five main structures, even different structures are possible and sometimes useful, such as:

(VI) $B/D_1+C/D_2$ (VII) $B/D_1+C_1/D_2+C_2$ wherein $D_1$ and $D_2$ are the same or different emulsions and wherein $C_1$ and $C_2$ are the same or different pigments.

AS already said, even structures coated on both sides are sometimes useful, such as:

(VIII) D/C/B/C/D (IX) D+C/B/D+C.

Each structure can have advantages with respect to the other ones according to the desired results. For instance, when high sensitivity and the exposure from the support base are desired, as for some types of materials for photocomposition, the structure B/D/C can be used. When there is no need of high sensitivity but merely of a strong internal antihalation power, the structure B/D+C can be used. The total coverage of the tannable materials contained in the layers coated on a single side is preferably lower than 5 $g/m^2$ per side, more preferably lower than 3.5 $g/m^2$ per side and most preferably lower than 2.5 $g/m^2$ per coated side, whatever may be the material structure.

For instance, in structure B/C/D, the thickness of D is preferably lower than 1 $g/m^2$, while the thickness of C is lower than 4 $g/m^2$, more preferably than 2.5 $g/m^2$ and most preferably than 1.5 $g/m^2$.

In calculating the thickness, it is in fact advantageous in the present technology to take into consideration the grams of gelatin and/or of the other tannable materials coated per surface unit and not the geometrical thickness which depends also upon the content of other materials such as halides, pigments, auxiliaries or solvents.

As already said, it is preferred totally or partially to incorporate the developers into the materials, so that the preferred photographic systems according to the present invention involve a mere activating bath instead of a developing bath. Such activating baths are water solutions of alkaline bases, such as carbonates, bicarbonates, hydroxides, phosphates, etc., alone or in combination.

The present invention preferably employes simple carbonate-bicarbonate or carbonate-hydroxide compositions to adjust the pH-value, which can be added with neutral salts to adjust the film swelling independently upon the buffering power or from the solution pH.

Examples of preferred solutions are those of potassium carbonate, with or without bicarbonate or hydroxide, at concentration comprised in the range from 6 to 26%, more preferably from 9 to 21% and most preferably from 12 to 18% and with a pH in the range from 9 to 13.6, preferably from 9.8 to 12.8 and most preferably from 10.3 to 12.3.

The temperature of the activating bath is preferably in the range from 20° to 40° C., more preferably from 25° to 35° C. and most preferably from 28° to 33° C. Stirring is maintained at the minimum, but can also be raised like that of some processing machines which can be found on the market. The man skilled in the art however prefers to have turbulence constant and under control, whatever it may be.

The activating bath is usually followed by baths which have the purpose of decreasing the salt concentration of the layers and making the undeveloped regions more soluble to be then removed with water.

A preferred method consists of using water sprays to remove the non-tanned portions of the layers.

The temperature of the sprays can be in the range from 1° to 99° C. or preferably from 10° to 40° C. The pressure of the sprays is preferably lower than 6 Bar.

For energy reasons, it is preferred to use a limited quantity of warm solution to swell the material after the activation and to completely remove the undeveloped portions of the layers by means of cold water sprays. It is also possible however to wash with hot water or steam or with different fluids, such as solutions, emulsions, suspensions, dispersions, foams or fogs, with or without the aid of sponges or brushes under rotation or vibration or with ultrasounds.

The activating bath can be added with known auxiliary substances to adjust the pH, pAg, fog, the silver development rate, etc. A particularly suitable activating bath consists of a simple base solution, such as a potassium carbonate solution; it is in fact very stable, provided that care is taken in compensating for the water evaporated into the atmosphere and the slow pH decrease due to the absorption of carbon dioxide and to the formation of halogenidric acids during the development.

In fact, the activating bath pH, temperature and concentration are among the important parameters to be kept under control.

Very important are also the type, the ratios and the quantities of the tanning developers used.

One of the most important parameters according to the present invention is the ratio between the total weight of the tannable materials (gelatin) of the coated layers (C+D) and the weight of the tanning developer contained in the same coated layers. (Unless otherwise indicated ratio means here and wherever in this text weight-to-weight ratio).

The above ratio is generally in the range from 3 to 1000, preferably from 5 to 500 and most preferably from 10 to 150.

Moreover, optimum quantities of the developers according to the present invention have been found to be slightly lower than the quantities of the same developers which would be necessary if used alone to optimize the photographic results. If hydroquinone alone is used, the optimization of the photographic results (in the presence of phenidone) requires gelatin/hydroquinone ratios in the range from 80 to 250, while good results are obtained even with a gelatin/hydroquinone ratio higher than 500 if methyl gentisate is added in a gelatin/gentisate ratio of about 40–60 according to the invention.

On the contrary, satisfying images are not obtained with methyl gentisate alone by using gelatin/gentisate ratios higher than 20.

When the developer combination according to this invention comprises hydroquinone, it may be useful to take into consideration the ratio between the hydroquinone moles or the moles of 1,4-dihydroxybenzene compounds having STDT values from one fourth to twice the hydroquinone STDT value and the sum of the moles of all other tanning developers. Such ratio has been found to be usefully in the range from 0.02 to 2, preferably in the range 0.1 to 1 and more preferably in the range from 0.2 to 0.5.

The following examples illustrate the present invention with experiments made on the following tanning developer compounds:

(I) Hydroquinone
(II) sodium 2,5-dihydroxybenzene-sulfonate
(III) Methyl gentisate
(IV) Chloro-hydroquinone
(V) Tetrachloro-hydroquinone
(VI) 2,5,2',5'-tetrahydroxydiphenyl-sulfone
(VII) β-hydroxyethylgentisamide
(VIII) 2,5-dihydroxy-benzene-phenylsulfone
(IX) Gentisic acid
(X) 2,5-hydroxyacetophenone
(XI) Gentisamide
(XII) Bromohydroquinone
(XIII) Sodium 1,4-dihydroxybenzene-2,5-disulfonate.

EXAMPLE 1

Seven photographic films were prepared, processed and evaluated according to the procedure described hereinbefore. Table 1 shows the tanning developers and their quantity used in the photographic films. For reasons of easier understanding, in such table and in all other tables, the first column reports the hydroquinone I (Hy), the second column the 1,4-dihydroxybenzene compounds having a STDT of two times to fifteen times the STDT of Hy, when measured under a gelatin/1,4-dihydroxybenzene compound ratio like the gelatin/hydroquinone ratio, and the third column reports the 1,4-dihydroxybenzene compounds having a STDT of one fourth to twice the STDT of Hy, when measured under a gelatin/1,4-dihydroxybenzene compound ratio like the gelatin/hydroquinone ratio. The table also reports the STDT values obtained for each film at the indicated amounts of tanning developers.

TABLE I

| FILM | Developer g/m² | | | STDT |
|---|---|---|---|---|
| no. | No./g | No./g | No./g | sec |
| 1 | I 0.024 | — | — | 35" |
| 2 | — | II 0.29 | — | 55" |
| 3 | I 0.022 | II 0.29 | — | 15" |
| 4 | — | III 0.29 | — | 60" |
| 5 | I 0.022 | III 0.22 | — | 18" |
| 6 | — | — | IV 0.055 | 35" |
| 7 | I 0.022 | — | IV 0.055 | 15" |

Table I shows that developers I and II, used alone in Films 1 and 2, produce slower tanning processes than their combination I+II in Films 3.

Similarly, a comparison among Films 1, 4 and 5 shows that the combination of developers I+III is much quicker (Film 5) than the single structures I and III (Films 1 and 4).

A similar effect is evident also from a comparison between Films 1 and 6 with 7 respectively containing the single compounds I and IV and their combination I+IV.

The synergism of the developer combinations of the present invention often regards also the image quality of the maintenance of the photographic properties under damp heat conditions.

For example, Films 1 to 7 were aged for 15 hours at 20° C. and 55% R.H. and then closed in impermeable envelopes and submitted to an accellerated storage at 50° C. for 1 day and 5 days.

After such a time, the samples were exposed, processed and evaluated as described above and the obtained images were compared with those previously obtained with fresh films.

The following results were thus obtained:

(1) all fresh films, with the exception of no. 4 (which gave a very bad quality with poor adhesion), at the development times described in Table I, gave very good qualities.

(2) the films stored for 1 day and for 5 days at 50° C. gave the results reported in the following Table IB.

TABLE IB

| Film | After 1 day | After 5 days |
|---|---|---|
| 1 | 60" necessary to obtain same quality of fresh film | Low adhesion, unacceptable quality even with long activation times |
| 2 | Like Film 1, but with a worse image | Low adhesion and very bad image |
| 3 | Slightly worse qualities at the same times of fresh film | Good qualities up to 80% dot. Adhesion defects above 80% dot |
| 4 | No image obtained (adhesion zero) | Adhesion zero |
| 5 | Worse image | No image (adhesion zero) |
| 6 | Like fresh film | Inversion (separation) above 80% dot and strong closings beyond |
| 7 | Like fresh film | Worse image, but even complete and acceptable |

EXAMPLE 2

Eleven films were prepared as described in Example 1 with the exception that they contained the developers reported in Table II.

The films were exposed, processed and evaluated as those of Example 1 and gave the evaluations of the minimum activation times reported in Table II.

The only structural differences with respect to the materials of Example 1 were that:

(a) D layers of Films 1, 3, 5 and 7 contained 0.87 g/m² of gelatin (instead of 0.5g/m²);

(b) D layers of Films 2, 4, 6 and 8 contained 0.64 g/m² of gelatin.

As shown in Table II, Films from 1 to 6 all have tanning development times higher than those of Films 7 to 11.

Moreover, Films 4, 10 and 11 were also aged for 15 hours at 20° C. and 55% R.H. and then closed in an impermeable envelope and stored at 50° C. for 3, 6 and 10 days, then exposed, processed and evaluated as described in Example 1. The following results were thus obtained:

(a) after 3 days: Film 10 was slightly worse. Films 4 and 11 were still good and with images like the fresh film.

(b) after 6 days: Film 10 gave no more image (which separates from the base during processing). Film 4 was worse, yet produced still acceptable images. Film 11 is still good almost like the fresh film.

(c) after 10 days: Even Film 4 did no more give acceptable images, while Film 11, even significantly worse, produced still acceptable images.

TABLE II

| Film | Developer g/m² | | | STDT |
|---|---|---|---|---|
| no. | No./g | No./g | No./g | sec |
| 1 | — | — | IV 0.055 | 32" |
| 2 | — | — | IV 0.055 | 31" |
| 3 | — | — | IV 0.04 | 35" |
| 4 | — | — | IV 0.04 | 35" |
| 5 | — | — | IV 0.02 | 40" |
| 6 | — | — | IV 0.02 | 38" |
| 7 | I 0.018 | — | IV 0.04 | 15" |
| 8 | I 0.018 | — | IV 0.04 | 15" |
| 9 | I 0.018 | — | IV 0.04 | 15" |
| 10 | I 0.019 | III 0.058 | — | 26" |
| 11 | I 0.019 | — | IV 0.04 | 15" |

EXAMPLE 3

Thirteen films were prepared as described in Example 1, with the exception of the developer quantities shown in Table III. They were then exposed, processed and evaluated as the materials of Example 1.

As shown in Table III, all Films from 1 to 13 had a tanning development time lower than that of Films 1, 4 and 6 of Example 1.

TABLE III

| Film | Developer g/m² | | | STDT |
|---|---|---|---|---|
| no. | No./g | No./g | No./g | sec |
| 1 | I 0.0037 | X 0.036 | IV 0.018 | 20" |
| 2 | I 0.0037 | X 0.023 | IV 0.018 | 23" |
| 3 | I 0.0037 | X 0.014 | IV 0.018 | 25" |
| 4 | — | III 0.05 | IV 0.044 | 22" |
| 5 | — | III 0.05 | IV 0.037 | 23" |
| 6 | — | III 0.05 | IV 0.031 | 24" |
| 7 | — | III 0.037 | IV 0.044 | 24" |
| 8 | — | III 0.037 | IV 0.037 | 24" |
| 9 | — | III 0.037 | IV 0.031 | 26" |
| 10 | I 0.024 | III 0.05(*) | — | 22" |
| 11 | I 0.024 | III 0.05(**) | — | 22" |
| 12 | I 0.006 | III 0.05(*) | IV 0.018 | 20" |
| 13 | I 0.006 | III 0.05(**) | IV 0.018 | 20" |

(*)added dissolved in alcohol.
(**)added dispersed in water-insoluble high-boiling solvents.

EXAMPLE 4

Five films were prepared as described in Example 1 with the exception of the developer type and quantity shown in Table IV. They were then exposed, processed and evaluated as described in Example 1.

Table IV shows that all Films from 1 to 5 have tanning development times lower than those of Films 1, 4 and 6 of Example 1.

The stability of Films 2, 3, 4 and 5 was better than that of Film 1.

TABLE IV

| Film | Developer g/m² | | | STDT |
|---|---|---|---|---|
| no. | No./g | No./g | No./g | sec |
| 1 | I 0.024 | III 0.05 | — | 21" |
| 2 | I 0.018 | III 0.05 | IV 0.006 | 15" |
| 3 | I 0.012 | III 0.05 | IV 0.012 | 15" |
| 4 | I 0.006 | III 0.05 | IV 0.018 | 15" |
| 5 | — | III 0.05 | IV 0.024 | 23" |

EXAMPLE 5

Four films were prepared as described in Example 1, with the exception that hydroquinone was placed into sensitive layer (D), instead of the first layer (C).

The developer type and quantity of the materials are shown in Table IV.

The films were exposed, processed and evaluated as those of Example 1. It is worth being pointed out that phenidone was not used in Film 3 (while it was present in all other films of this example and of the peceding examples in the position and coverage described in Example 1).

As shown in Table V, Films 1, 2 and 4 have a good tanning development rate if compared with Films 1 and 4 of Example 1. Film 4 presents however a better tone reproduction.

Film 3 did not give any image since, under the operative conditions of the examples, the presence of at least small quantities of 3-pyrazolidone compounds were necessary.

TABLE V

| Film | Developer g/m² | | | STDT |
|---|---|---|---|---|
| no. | No./g | No./g | No./g | sec |
| 1 | I 0.01 | III 0.06 | — | 30" |
| 2 | I 0.01 | III 0.06 | — | 30" |
| 3(**) | I 0.01 | III 0.06 | — | (*) |
| 4 | I 0.01 | III 0.06 | IV 0.032 | 25" |

(*)No obtainable image
(**)Phenidone absent

EXAMPLE 6

Fifteen films were prepared as described in Example 1, with the exception of the variations shown in Table VI and then exposed, processed and evaluated as those of Example 1.

Table VI shows that the single developers VII, XI and VI gave nearly good tanning development rates only if used at very high quantities. Their development rates were however much lower taht those obtainable with Film 14 which contained a combination of developer VI with other hydroquinone structures or than those obtainable with combinations of developer I in several films of the preceding examples.

The high coverages, on the contrary, were not effective in the case of the single developers IX, X, III, II, V and XIII which were anyhow very slow.

Halogen-hydroquinones IV and XII gave mean tanning development rates, yet lower than the binary combinations like those of Film 7 of Example 1 or of Films 7, 8, 9 and 11 of Example 2.

TABLE VI

| FILM | Developer g/m² | | | STDT |
|---|---|---|---|---|
| no. | No./g | No./g | No./g | sec |
| 1 | — | — | VII 0.22 | 40" |
| 2 | — | III 0.22 | — | 55" |
| 3 | — | VIII 0.22 | — | 55" |
| 4 | — | — | VI 0.22 | 30" |
| 5 | — | IX 0.15 | — | 90" |
| 6 | — | X 0.22 | — | 65" |
| 7 | — | X 0.07 | — | 80" |
| 8 | — | — | XI 0.16 | 28" |
| 9 | — | III 0.15 | — | 65" |
| 10 | — | II 0.31 | — | 50" |
| 11 | — | — | IV 0.055 | 38" |
| 12 | — | V 0.11 | — | 90" |
| 13 | — | — | XII 0.07 | 36" |
| 14 | I 0.06 | V 0.022 | VI 0.07 | 10" |

TABLE VI-continued

| FILM | Developer g/m² | | | STDT |
|---|---|---|---|---|
| no. | No./g | No./g | No./g | sec |
| 15 | — | XIII 0.55 | — | 70" |

EXAMPLE 7

Seven films were prepared as described in Example 1, with the exception of the variations shown in Table VII, then exposed, processed and evalulated like those of Example 1.

Developer I in Films 1, 2, 3, 4, 5 and 6 however was placed into D layer, like developer VI in Film 7.

All other developers were placed into layer C, as usual.

This example illustrates the effectiveness of the combinations comprising developers I and VI with or without developer V, since they gave lower tanning development times than Film 1 of Example 1 and Film 4 of Example 6, although the quantity of developer VI in the present example was much lower than that of Film 4 of Example 6.

TABLE VII

| FILM | Developer g/m² | | | STDT |
|---|---|---|---|---|
| no. | No./g | No./g | No./g | sec |
| 1 | I 0.006 | V 0.03 | VI 0.037 | 23" |
| 2 | I 0.006 | V 0.03 | VI 0.027 | 25" |
| 3 | I 0.006 | — | VI 0.037 | 24" |
| 4 | I 0.005 | V 0.03 | VI 0.037 | 23" |
| 5 | I 0.005 | V 0.03 | VI 0.027 | 26" |
| 6 | I 0.005 | — | VI 0.037 | 23" |
| 7 | I 0.018 | V 0.03 | VI 0.01 | 22" |

EXAMPLE 8

Six films were prepared as described in Example 1, with the exception of the variations reported in Table VIII, then exposed, processed and evaluated like those of Example 1.

As evidenced in Table VIII, the good tanning development rates of the developer I and VI mixture were confirmed, even if the quantities of both developers were so low that, if used alone, they would not give any satisfying image.

TABLE VIII

| FILM | Developer g/m² | | | STDT |
|---|---|---|---|---|
| no. | No./g | No./g | No./g | sec |
| 1 | I 0.006 | — | VI 0.037 | 24" |
| 2 | I 0.004 | — | VI 0.037 | 26" |
| 3 | I 0.003 | — | VI 0.037 | 28" |
| 4 | I 0.006 | — | VI 0.027 | 27" |
| 5 | I 0.006 | — | VI 0.022 | 30" |
| 6 | I 0.006 | — | VI 0.014 | 30" |

EXAMPLE 9

Seven films were prepared as described in Example 1 with the exception of the variations shown in Table IX, then exposed, processed and evaluated like those of Example 1.

While however the phenidone quantity in Films 1, 2, 5, 6 and 7 was like that of the films of Example 1, in Film 3 phenidone was coated at 0.0125 g/m² and in Film 4 was not placed at all.

As shown in Table IX, Films 1, 2, 3, 5, 6 and 7 gave a good tanning development rate, thus showing that under the present experimental conditions the phenidone quantity can also be reduced to the half.

On the contrary, Film 4 did not give any image since phenidone was absent. The results of this example confirmed the effectiveness of the combinations of at least two hydroquinone structures and proved also the usefulness of the presence of at least one 3-pyrazolidone compound, at least at a minimum quantity, to improve adhesion under the described experimental conditions.

TABLE IX

| FILM | Developer g/m² | | | STDT |
|---|---|---|---|---|
| no. | No./g | No./g | No./g | sec |
| 1 | I 0.018 | III 0.055<br>III 0.055 | — | 27" |
| 2 | I 0.018 | +<br>V 0.03 | — | 24" |
| 3 | I 0.018 | III 0.055 | — | 25" |
| 4 | I 0.018 | III 0.055 | — | (*) |
| 5 | I 0.018 | III 0.055 | — | 28" |
| 6 | I 0.018 | III 0.03 | — | 25" |
| 7 | I 0.018 | III 0.06 | — | 25" |

(*) No image.

EXAMPLE 10

Seven films were prepared as described in Example 1, with the exception of the variations described in Table XI, then exposed, processed and evaluated like those of Example 1.

A comparison of Film 1 with Films 2 and 3, as well as with Film 4 of Example 6 confirmed the necessity of very high coverages when hydroquinones substituted with electron-attracting groups were used alone.

Films 4, 5, 6 and 7 on the contrary showed that the synergistic effect on the tanning development is strong when developer VI was combined with other hydroquinone structures.

TABLE X

| FILM | Developer g/m² | | | STDT |
|---|---|---|---|---|
| no. | No./g | No./g | No./g | sec |
| 1 | — | — | VI 0.073 | 40" |
| 2 | — | — | VI 0.036 | 55" |
| 3 | — | — | VI 0.018 | 90" |
| 4 | I 0.006 | — | VI 0.036 | 27" |
| 5 | I 0.006 | V 0.22 | VI 0.036 | 27" |
| 6 | — | III 0.055 | VI 0.036 | 28" |
| 7 | — | III 0.055 | VI 0.018 | 32" |

EXAMPLE 11

Five films were prepared as described in Example 1, with the exception of the variations described in Table XI, then exposed, processed and evaluated as those described in Example 1.

While Film 1, like the films of the preceding examples, contained 0.75 g/m² of black colloidal silver as a pigment in layer C, Films 2, 3, 4 and 5 contained, in layer C, 4 g/m² of an organic pigment dispersion consisting of 1.5 g/m² of pure pigments and about 2.5 g/m² of solvents for the dispersion.

Although the gelatin thickness per square meter of layer C was still 2.2 g/m², layer C of Films 2, 3, 4 and 5 showed a lower tendency to be tanned than layer C of material 1 of the present example and of Film 1 of Example 1.

In fact, a comparison of Films 2, 3 and 4 of the present example with Film 1 of Example 1 shows that substantially lower tanning development rates were obtained if similar quantities of developer I alone were used.

A comparison of Films 2, 3, 4 of the present example with Film 5 and even with Film 1 does however clearly show that it is sufficient to put a given quantity of Compound III in combination with Compound I to obtain not only a much higher tanning development rate both for Film 5 and for Films 2, 3 and 4, but that it is nearly the same as that of Film 1 wherein the colloidal silver pigment tannability is higher.

TABLE XI

| FILM | Developer g/m² | | | STDT |
|---|---|---|---|---|
| no. | No./g | No./g | No./g | sec |
| 1(*) | I 0.02 | III 0.058 | — | 25" |
| 2(**) | I 0.024 | — | — | 55" |
| 3(**) | I 0.02 | — | — | 60" |
| 4(**) | I 0.016 | — | — | 80" |
| 5(**) | I 0.02 | III 0.058 | — | 28" |

(*)Black colloidal silver as pigment
(**)Black mixture of organic pigments.

EXAMPLE 12

Nine films were prepared as described in Example 1, with the exception of the variations described in Table XII, then exposed, processed and evaluated like those of Example 1.

Films 4 and 6 had 0.55 g/m² of silver ions in the D sensitive layer, Film 8 had 0.3 g/m² of silver ions and Film 9 had 0.25 g/m² of silver ions.

All other films had a quantity of silver ions equal to 0.35 g/m² as the films of the preceding examples.

Such differences in the coverage of the photographic emulsion (and therefore in the quantity of the exposed and developable silver) did not prove however to be so important to the purposes of the tanning development rate as on the contrary the combinations of at least two hydroquinone structures, such as I+III in Films 1, 2, 7, 8, 9 with respect to the single structures of Films 3, 4, 5, 6.

In fact, Film 9, which had a very low emulsion coverage, was still faster than Films 4 and 6 which had twice a coverage.

Films 4 and 6 had furthermore a tanning development rate similar to that of Films 3 and 5 independently upon the sensitive silver coverage.

TABLE XII

| FILM | Developer g/m² | | | STDT |
|---|---|---|---|---|
| no. | No./g | No./g | No./g | sec |
| 1 | I 0.02 | III 0.068 | — | 25" |
| 2 | I 0.02 | III 0.058 | — | 25" |
| 3 | — | II 0.314 | — | 45" |
| 4 | — | II 0.314 | — | 45" |
| 5 | — | III 0.23 | — | 65" |
| 6 | — | III 0.23 | — | 60" |
| 7 | I 0.02 | III 0.058 | — | 25" |
| 8 | I 0.02 | III 0.058 | — | 25" |
| 9 | I 0.02 | III 0.058 | — | 35" |

EXAMPLE 13

Six films were prepared as described in Example 1, with the exception of the variations described in Table XIII, then exposed, processed and evaluated as described in Example 1.

From the comparison with Films 1, 4 and 6 of Example 1 and taking into consideration the very low coverages of developers I, III and IV used in this example, the synergism of the binary I+IV mixtures in Films 4, 5 and 6 and of the ternary ones in Films 1, 2 and 3 to the purposes of tanning development was noticed.

Moreover, Films 1, 2 and 3 gave a reproduction of a 3% dot, of very thin lines and of the tones substantially better than Films 3, 4 and 5, thus showing that the effect of further hydroquinone structures, such as III, may result useful to the purposes of both the tanning development rate and image improvement.

All this is particularly surprising if the particularly bad images are considered which were obtained by using developer III alone, as done in Film 4 of Example 1 and in Films 2 and 9 of Example 6.

TABLE XIII

| FILM | Developer g/m² | | | STDT |
|---|---|---|---|---|
| no. | No./g | No./g | No./g | sec |
| 1 | I 0.006 | III 0.048 | IV 0.018 | 20" |
| 2 | I 0.006 | III 0.031 | IV 0.018 | 22" |
| 3 | I 0.006 | III 0.016 | IV 0.018 | 24" |
| 4 | I 0.006 | — | IV 0.018 | 30" |
| 5 | I 0.003 | — | IV 0.031 | 28" |
| 6 | I 0.003 | — | IV 0.044 | 25" |

The Standard Tanning Development Times (STDT) reported in the preceeding examples refer to the operative conditions chosen for comparison purposes.

Such times can increase or decrease by varying some parameters of the film and processing in a way obvious to the man skilled in the art.

What is claimed is:

1. A photographic material for tanning development including a photographic support base, a tannable binder material, a silver halide emulsion and at least one pigment, characterized by including a 3-pyrazolidone compound and at least two different 1,4-dihydroxybenzene compounds, the first of which is chosen within the group of these having a standard tanning development time (STDT) of from one fourth to twice the hydroquinone STDT (STDTHy) and the second of which is chosen within the group of those having a STDT of one fourth to fifteen times the STDTHy.

2. The photographic material according to the preceding claim 1, wherein the first 1,4-dihydroxybenzene compound is chosen within the group of those having a STDT of from one fourth to twice the STDTHy and the second 1,4-dihydroxybenzene compound is chosen within the group of those having a STDT of two times to fifteen times the STDTHy.

3. The photographic material according to claim 1, characterized by including a 3-pyrazolidone compound, hydroquinone, a 1,4-dihydroxybenzene compound, other than hydroquinone, chosen within the group of those having a standard tanning development time (STDT) of from one fourth to twice the hydroquinone STDT (STDTHy) and a 1,4-dihydroxybenzene compound chosen within the group of those having a STDT of two times to fifteen times the STDTHy.

4. The photographic material according to claim 1, wherein the 1,4-dihydroxybenzene compounds are those in which at least one hydrogen atom of the benzene nucleus is substituted with a halogen atom and/or with an electron-withdrawing substituent.

5. The photographic material according to the preceding claim 4, wherein the electron-withdrawing substituent is chosen in the group comprising carboxyl and the functional derivatives thereof, carbonylketone, sulfonyl, sulfonic group, sulfonylamido, the quaternary ammonium and sulfonium group, nitrile and trifluoromethyl.

6. The photographic material according to claim 1, wherein the 1,4-dihydroxybenzene compounds having a STDT from one fourth to twice the STDTHy are chosen in the group comprising hydroquinone, gentisamide, N-alkyl-gentisamides, wherein the alkyl group has a low molecular weight and can be substituted with a hydroxyl group, mono-halogen-hydroquinone and 2,5,2',5'-tetrahydroxydiphenylsulfone.

7. The photographic material according to claim 6, wherein the 1,4-dihydroxybenzene compounds are chosen in the group comprising hydroquinone, gentisamide, β-hydroxyethylgentisamide, monochlorohydroquinone, monobromohydroquinone and 2,5,2',5'-tetrahydroxydiphenylsulfone.

8. The photographic material according to claim 2, wherein the 1,4-dihydroxybenzene compounds having a STDT of two times to fifteen times the STDTHy are chosen in the group comprising gentisic acid, gentisic acid alkyl esters in which the alkyl group has a low molecular weight, 2,5-dihydroxybenzeneketones, 2,5-dihydroxybenzensulfonic acids and the alkali metal salts thereof, 2,5-dihydroxybenzensulfones and poly-halogen-hydroquinones.

9. The photographic material according to claim 8, wherein the 1,4-dihydroxybenzene compounds are chosen in the group comprising gentisic acid, methylgentisate, 2,5-dihydroxyacetophenone, sodium 2,5-dihydroxybenzenesulfonate, sodium 1,4-dihydroxybenzene-2,5-disulfonate, 2,5-dihydroxy-benzenephenylsulfone and tetrachlorohydroquinone.

10. The photographic material according to claim 1, wherein the total sum of the whole tannable binder material is lower than 5 g/m$^2$.

11. The photographic material according to claim 1, wherein the ratio between the total quantity of the tannable binder material and the total quantity of the 1,4-dihydroxybenzene compounds and hydroquinone is comprised between 5 and 150.

12. A method to obtain relief images, characterized in that a photographic material according to claim 1 is exposed to the light, then the exposed photographic material is processed in a suitable processing bath and the unhardened tannable material is then removed with water.

13. The photographic material according to claim 3, wherein the total sum of the whole tannable binder material is lower than 5 g/m$^2$.

14. The photographic material according to claim 9, wherein the total sum of the whole tannable binder materal is lower than 5 g/m$^2$.

15. The photographic material according to claim 5, wherein the ratio between the total quantity of the tannable binder material and the total quantity of the 1,4-dihydroxybenzene compounds and hydroquinone is comprised between 5 and 150.

16. The photographic material according to claim 7, wherein the ratio between the total quantity of the tannable binder material and the total quantity of the 1,4-dihydroxybenzene compounds and hydroquinone is comprised between 5 and 150.

17. The photographic material according to claim 10, wherein the ratio between the total quantity of the tannable binder material and the total quantity of the 1,4-dihydroxybenzene compounds and hydroquinone is comprised between 5 and 150.

18. A method to obtain relief images, characterized in that a photographic material according to claim 3 is exposed to the light, then the exposed photographic material is processed in a suitable processing bath and the unhardened tannable material is then removed with water.

19. A method to obtain relief images, characterized in that a photographic material according to claim 8 is exposed to the light, then the exposed photographic material is processed in a suitable processing bath and the unhardened tannable material is then removed with water.

20. A method to obtain relief images, characterized in that a photographic material according to claim 11 is exposed to the light, then the exposed photographic material is processed in a suitable processing bath and the unhardened tannable material is then removed with water.

* * * * *